US008062510B2

(12) United States Patent
Keatch

(10) Patent No.: US 8,062,510 B2
(45) Date of Patent: Nov. 22, 2011

(54) HYDROCARBON RECOVERY TECHNIQUES

(75) Inventor: Richard Keatch, Aberdeenshire (GB)

(73) Assignee: M-I Production Chemicals UK Limited, Aberdeen (GB)

( * ) Notice: Subject to any disclaimer, the term of this patent is extended or adjusted under 35 U.S.C. 154(b) by 542 days.

(21) Appl. No.: 11/684,060

(22) Filed: Mar. 9, 2007

(65) Prior Publication Data

US 2007/0209970 A1 Sep. 13, 2007

Related U.S. Application Data

(60) Provisional application No. 60/781,226, filed on Mar. 10, 2006.

(51) Int. Cl.
*C10G 31/00* (2006.01)
*C10G 17/04* (2006.01)

(52) U.S. Cl. ..... 208/370

(58) Field of Classification Search ..... 208/13, 208/311, 340, 370
See application file for complete search history.

(56) References Cited

U.S. PATENT DOCUMENTS

| | | | | |
|---|---|---|---|---|
| 1,393,507 | A | 10/1921 | Cornell | |
| 1,592,324 | A * | 7/1926 | Allinson | 208/187 |
| 2,497,946 | A * | 2/1950 | Lester | 134/22.18 |
| 3,355,893 | A | 12/1967 | Kuhne | |
| 3,608,773 | A * | 9/1971 | Coderre et al. | 220/567.2 |
| 3,654,951 | A * | 4/1972 | Pogonowski et al. | 137/355.16 |
| 3,745,770 | A | 7/1973 | Fraser et al. | |
| 4,676,314 | A | 6/1987 | Gussow et al. | |
| 4,679,627 | A | 7/1987 | Harrison | |
| 5,638,690 | A * | 6/1997 | Berglof | 62/84 |
| 5,660,231 | A | 8/1997 | Belonenko et al. | |
| 5,725,054 | A | 3/1998 | Shayegi et al. | |
| 5,778,977 | A * | 7/1998 | Bowzer et al. | 166/252.1 |
| 6,068,054 | A | 5/2000 | Bragg | |
| 6,253,801 | B1 | 7/2001 | Lie | |

FOREIGN PATENT DOCUMENTS

| | | |
|---|---|---|
| JP | 61089999 A | 5/1986 |
| RU | 2125154 | 1/1999 |
| RU | 2205948 | 6/2003 |

OTHER PUBLICATIONS

PCT International Search Report issued in PCT Application No. PCT/US2007/006163 dated Aug. 21, 2007 (3 pages).
PCT Written Opinion issued in PCT Application No. PCT/US2007/006163 dated Aug. 21, 2007 (4 pages).
Official Action for related Eurasian Application No. 200870345 dated Oct. 2, 2009. (4 pages).
Official Action for Eurasian Application No. 200870345/27 dated Jun. 1, 2009. (3 pages).
Office Action issued in Canadian Application No. 2,645,295 dated Apr. 29, 2010 (3 pages).

* cited by examiner

*Primary Examiner* — Glenn Caldarola
*Assistant Examiner* — Randy Boyer
(74) *Attorney, Agent, or Firm* — Osha Liang LLP

(57) ABSTRACT

A method for extracting hydrocarbons from a vessel by displacement. The method including the displacement of a hydrocarbon source with a material of different density and recovery of the hydrocarbons from the vessel. Additionally, a method for extracting hydrocarbons from a vessel by gas displacement through chemical introduction. The method including introduction of hydrochloric acid and sodium bicarbonate into a vessel, production of carbon dioxide from the reaction of the hydrochloric acid and the sodium bicarbonate, displacement of a hydrocarbon source inside the vessel, and recovery of the hydrocarbon source from the vessel.

16 Claims, 7 Drawing Sheets

HYDROCARBON RECOVERY TECHNIQUES

CROSS-REFERENCE TO RELATED APPLICATIONS

This application claims priority, pursuant to 35 U.S.C. §119(e) to U.S. patent application Ser. No. 60/781,226, filed on Mar. 10, 2006, which is herein incorporated by reference in its entirety.

FIELD OF THE DISCLOSURE

This disclosure relates generally to a technique for recovering hydrocarbons from a vessel. More specifically, this disclosure relates to a method for recovering hydrocarbons from a storage vessel by displacement.

BACKGROUND OF THE DISCLOSURE

Offshore drilling and production platforms used for recovering oil from subterranean formations disposed beneath ocean water include a number of structural support legs for supporting a plurality of work areas. Generally, below the work areas, a plurality of hollow concrete multi-cell structures may sit on the seabed floor. The hollow concrete multi-cell structures may be large, in some cases including over eighty cells, each cell reaching volumes of thousands of cubic meters.

Previously, the hollow concrete multi-cell structures may have been used to separate hydrocarbons from water, store hydrocarbons, or otherwise collect a hydrocarbon source. As a function of operation, hydrocarbons may become trapped in the hollow concrete multi-cell structures. The hydrocarbons trapped in the hollow multi-cell structures are often referred to in the industry as "attic oil."

At one time abandoned storage vessels could remain partially filled with residual hydrocarbons. One such source of abandoned hydrocarbons occurs in storage vessels awaiting decommission. Prior to decommissioning, the remaining hydrocarbons in the storage vessels must be removed. Additionally, to prevent contamination of the ecology around the hollow multi-cell structures, the decommissioning of storage vessels must occur in an environmentally clean manner.

While methods for removing oil from subterranean reservoirs are known to those skilled in the art, the methods are directed to the removal of oil from subsurface formations, and do not consider the constraints of removing oil from storage vessels, for example, above ground or on the seabed floor. One such method is disclosed by U.S. Pat. No. 4,676,314 ("the '314 patent"), hereby incorporated by reference herein. The '314 patent describes injecting air into the top of a subterranean formation that is filled with both oil and water. As the air displaces the water, the water flows out of the formation, the oil settles towards the bottom of the formation, and a well is dug to extract the oil which has settled to the bottom of the formation.

Another method is disclosed in U.S. Pat. No. 4,679,627 ("the '627 patent"), hereby incorporated by reference herein. The '627 patent describes injecting gas into a subterranean reservoir, forcing the oil to the bottom of the formation, and then generating pressure waves to release additional oil retained by the reservoir. The oil is then removed by drilling a well into the formation, and extracting the displaced oil from the bottom of the formation.

While the '314 patent and the '627 patent describe methods of injecting gas into a subterranean formation to recover oil trapped therein, the methods both involve drilling a well into the formation, an option that is not available when removing oil from a storage vessel on the seabed floor. Further, the prior disclosures remove the oil through an export location drilled through the top of a formation. On oil platforms, rather than being located on the top of the storage vessels, the export location is generally located below the hydrocarbon layer, thereby preventing removal though the simple pumping described in prior disclosures.

Accordingly, there exists a need for a method to extract hydrocarbons from storage vessels in an efficient, environmentally clean, and profitable manner.

SUMMARY OF THE DISCLOSURE

In one aspect, embodiments disclosed herein relate to a method for extracting hydrocarbons from a vessel. The method includes displacing a hydrocarbon source with a material of density different than that of the hydrocarbon source and recovering the hydrocarbons from the vessel.

In another aspect, embodiments disclosed herein relate to a method for extracting hydrocarbons from a vessel by gas displacement through chemical introduction. The method includes introducing hydrochloric acid and sodium bicarbonate into a vessel, producing carbon dioxide from the reaction of the hydrochloric acid and the sodium bicarbonate, displacing a hydrocarbon source inside the vessel, and recovering the hydrocarbon source from the vessel.

Other aspects and advantages of the invention will be apparent from the following description and the appended claims.

DESCRIPTION OF ILLUSTRATIVE EMBODIMENTS

Generally, embodiments disclosed herein relate to methods for removing hydrocarbons from vessels. More specifically, embodiments disclosed herein relate to the removal of hydrocarbons from vessels through displacement. In certain vessels, a first material (e.g. hydrocarbons) may be situated such as to prevent conventional extraction. Such a situation may occur when the first material forms a layer in a vessel that is filled with a second, more dense material (e.g. Water), wherein an export location (e.g. an export pipe) that would typically be used to pump out the first material is located below the first material layer. Thus, the first material may not be efficiently extracted without bringing the first material layer to the same level as the export location.

According to one embodiment of the present disclosure, a first material may be layered in a vessel above an export location. To remove the first material from the vessel, a second material that is less dense than the first material may be introduced into the vessel. As the second material fills the vessel, the first material may be displaced such that the first material comes into contact with the export location. The first material may then be recovered from the vessel.

In an alternate embodiment of the present disclosure, a vessel may contain a first material located below an export location. In such an embodiment, it may be beneficial to introduce a higher density material to displace a lower density material, such that the lower density material rises in the vessel. As the displaced material reaches the level of the export location, the displaced material may be removed accordingly.

In still another embodiment of the present disclosure, a vessel may contain several materials of differing densities. In such an embodiment, it may be beneficial to introduce materials of differing densities to facilitate the recovery of displaced materials therefrom. For example, a vessel may contain materials of three different densities layered therein. In order to displace one of the lighter materials, a higher density material may be introduced such that the lighter material moves upward in the vessel. Upon reaching an export location, the lighter material may then be recovered as described above.

Figure 1:
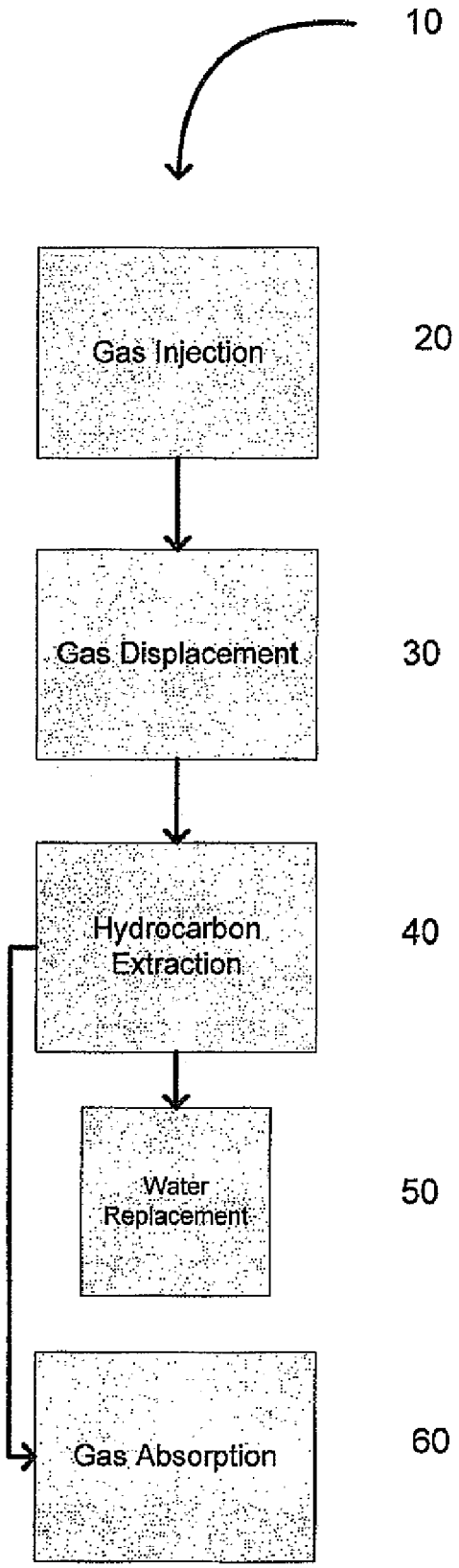
FIG. 1 is a block diagram of an embodiment of a method of direct gas injection in accordance with the present disclosure.

Generally, FIGS. 1 through 6 relate to an embodiment of the present disclosure involving hydrocarbon extraction by displacement resulting from gas injection. Referring initially to FIG. 1, a block diagram of an embodiment of a method of hydrocarbon recovery 10 in accordance with the present disclosure is shown. In this embodiment, a gas may be injected 20 into a storage vessel that contains a hydrocarbon source as described above. The gas may then displace 30 the water and hydrocarbon layer, bringing the hydrocarbon layer into fluid contact with an export pipe. The hydrocarbons may then be extracted 40 from the storage vessel. As the hydrocarbons are extracted 40, water may be reintroduced 50 into the storage vessel. The water replacement 50 may be provided from a header tank from an external pump, or by any means known to one of ordinary skill in the art. In certain embodiments, as hydrocarbon extraction 40 completes, a gas absorption 60 chemical may be introduced into the storage vessel to remove any gas that remains from gas injection 20. While the described method of hydrocarbon extraction includes the direct injection of gas, other embodiments employing other processes of gas displacement may be foreseen, and are within the scope of the present disclosure.

Figure 2:
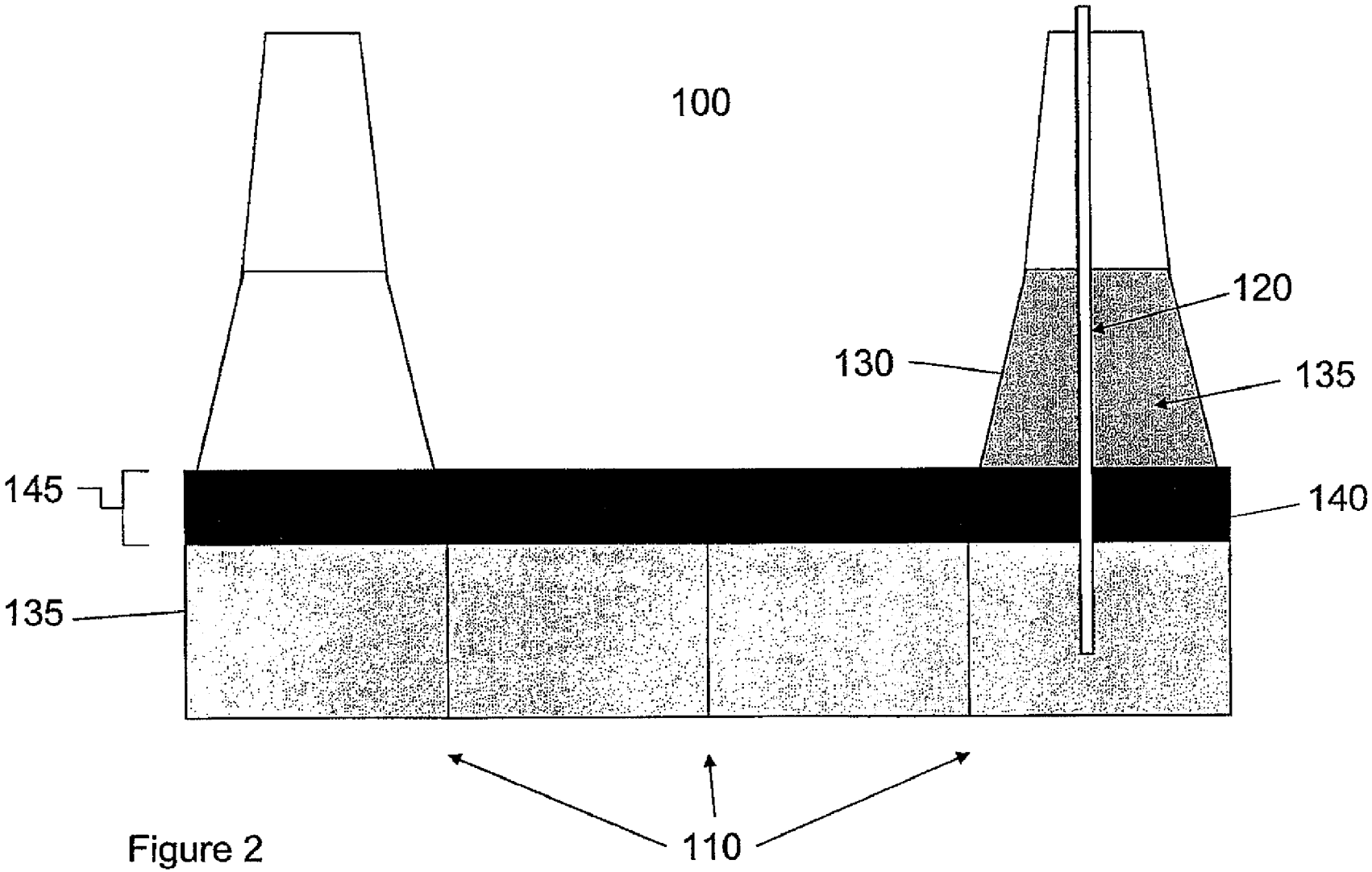
FIG. 2 is a schematic diagram of a hydrocarbon storage vessel in accordance with an embodiment of the present disclosure.

Referring now to FIG. 2, a method of recovering hydrocarbons from an oil platform storage system 100 is shown. Oil platform storage system 100 includes a plurality of hollow concrete multi-cell structures (storage vessels) 110, an export pipe 120, a header tank pipe 125, and a header tank 130. The plurality of storage vessels 110 may be fluidly connected to each other by interconnecting holes (not shown in detail). In certain systems, a single export pipe 120 may be connected to a plurality of storage vessels 110, multiple export pipes 120 may connect to groups of storage vessels 110, an export pipe 120 may be connected to each storage vessel 110, or multiple export pipes 120 may be connected to an individual storage vessel 110. Additionally, header tank 130 may be fluidly connected to at least one of storage vessels 110, and may contain additional water 135, among other fluids.

Prior to decommissioning, oil platform storage system 100 may contain, among other substances, water 135 and hydrocarbons (e.g. attic oil) 140. Typically, hydrocarbons 140 have a lower specific gravity than water 135. Thus, the hydrocarbons 140 may separate from the water 135 and form a hydrocarbon layer 145.

Figure 3:
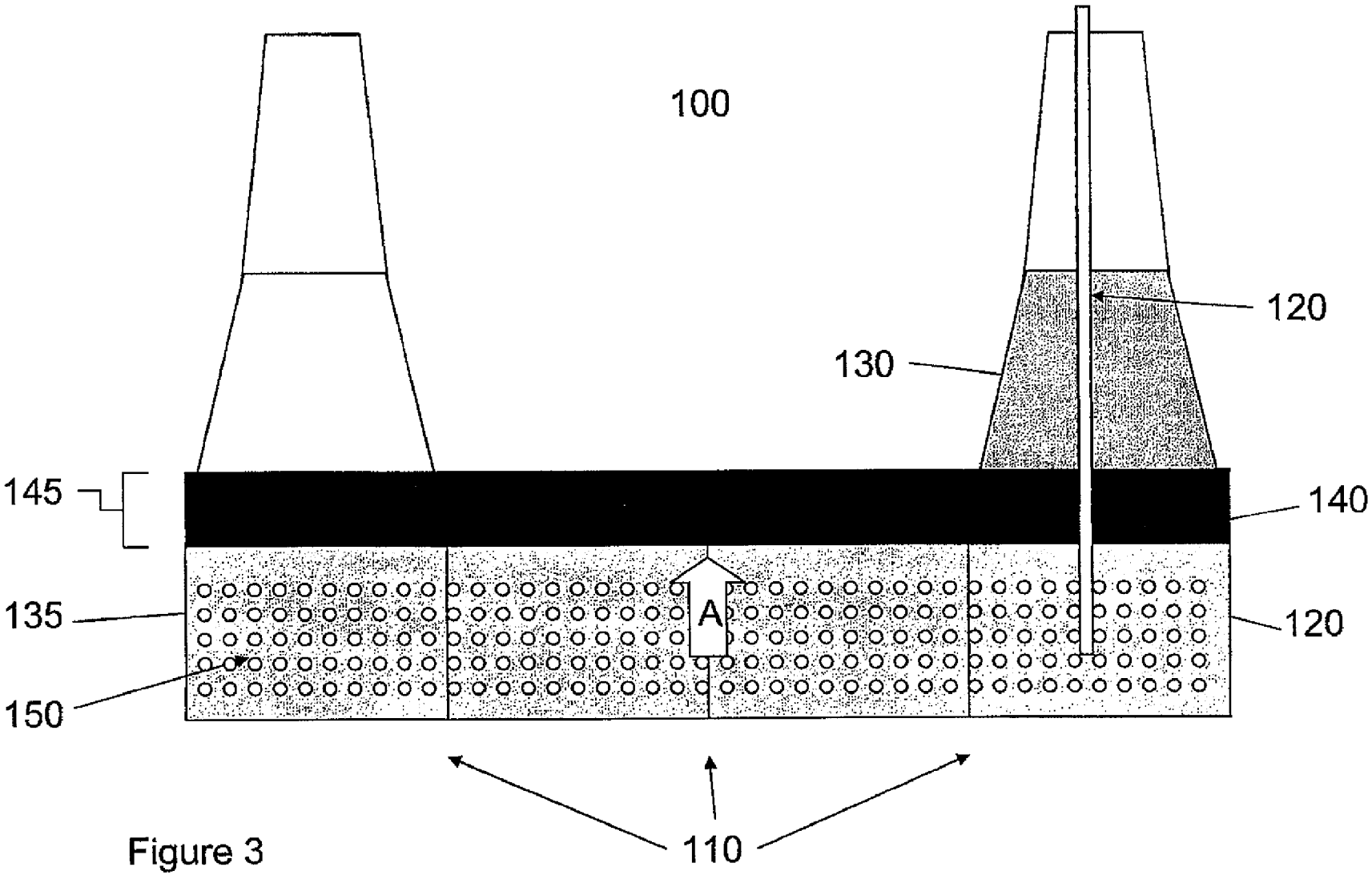
FIG. 3 is a schematic diagram of gas injection in accordance with an embodiment of the present disclosure.
Figure 4:
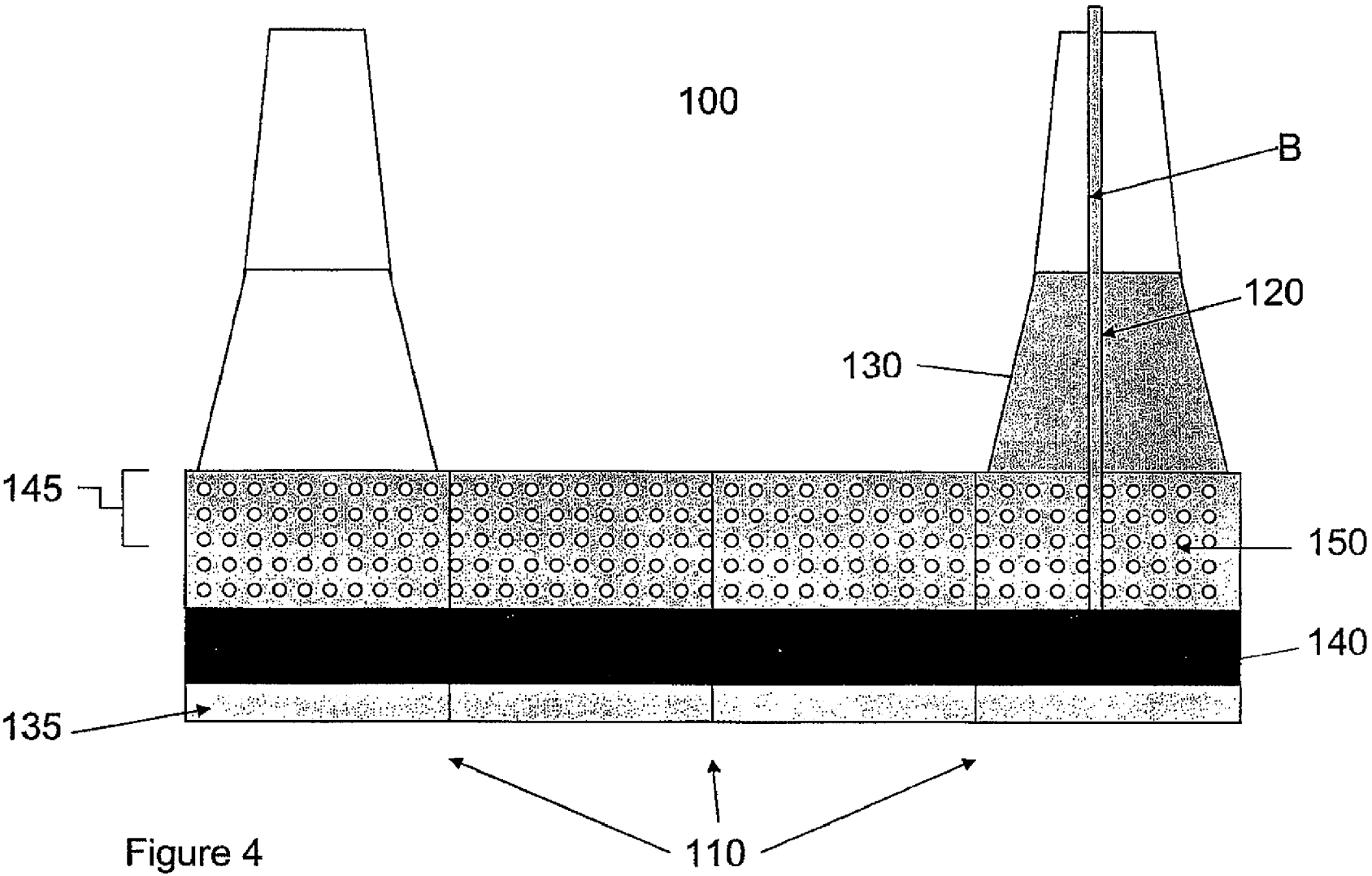
FIG. 4 is a schematic diagram of gas displacement in accordance with an embodiment of the present disclosure.

Referring now to FIGS. 3 and 4 together, the injection of a gas 150 into oil platform storage system 100, in accordance with one embodiment of the present disclosure, is shown. As illustrated, gas may be injected into storage vessels 110 through export pipe 120. As export pipe 120 may be located below hydrocarbon layer 145, the gas 150 will enter oil platform storage system 100 at a location below hydrocarbon layer 145. Because the specific gravity of gas 150 is less than the specific gravity of water 135, the gas will rise through the oil platform storage system 100 as illustrated by A. While in one embodiment of the present disclosure the displacement material is a gas, it should be realized that the material may be any liquid, solid, gas, or mixture thereof with a density such as to displace the hydrocarbon layer as desired.

As gas 150 reaches the top of storage vessels 110, the gas 150 begins to displace hydrocarbon layer 145. Because the specific gravity of gas 150 is less than the specific gravity of hydrocarbons 140, the hydrocarbon layer 145 may be displaced from the top of storage vessel 110, therein forced down in storage vessels 110 toward export pipe 120. When gas 150 displaces hydrocarbon layer 145, some water 135 may be forced out of storage vessels 110 through header tank pipe 125 (illustrated by B).

Figure 5:
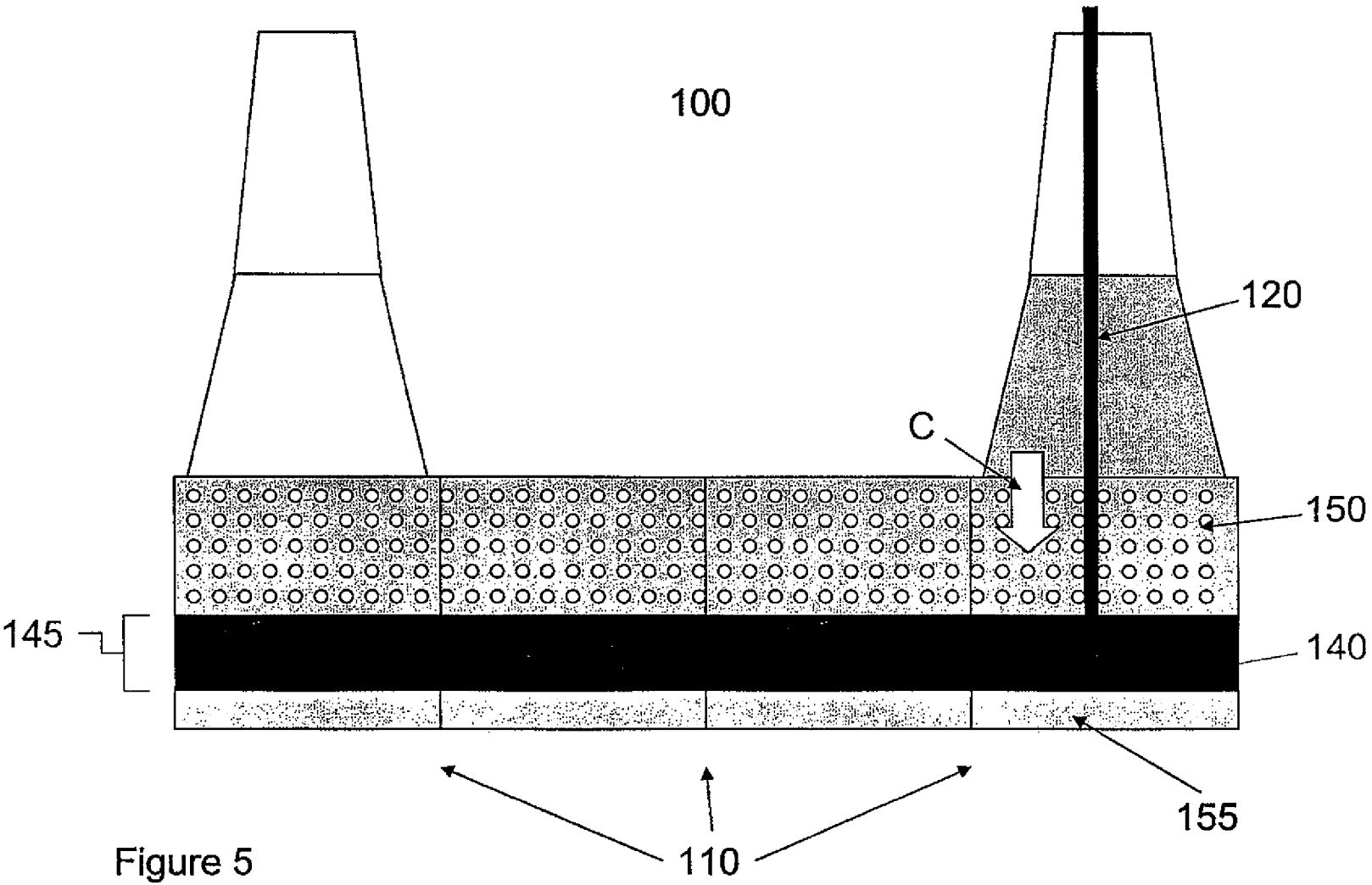
FIG. 5 is a schematic diagram of hydrocarbon extraction in accordance with an embodiment of the present disclosure.

Referring now to FIG. 5, the recovery of hydrocarbons 140, in accordance with one embodiment of the present disclosure, is shown. As gas 150 displaces hydrocarbon layer 145 in a downward direction, the hydrocarbons 140 may contact, or otherwise communicate with export pipe 120. When hydrocarbon layer 145 contacts export pipe 120, an external pump (not separately shown) connected to export pipe 120 may then begin extracting hydrocarbons 140 from storage vessel 110. Hydrocarbons 140 may then be transferred to the surface, or to another location, for storage and/or further processing.

As hydrocarbons 140 are removed, additional water (illustrated as C) may be introduced into storage vessel 110 from a header tank 130 through header tank pipe 125. Header tank 130 is typically present in at least one of the legs of an oil platform. The header tank 130 may be fluidly connected to the storage vessels 110, such that water may flow therebetween. While this embodiment illustrates the reintroduction of water into storage vessels 110, other embodiments may be foreseen wherein the storage vessels are left empty, contain residual gas, or contain other substances.

In certain embodiments, a layer of water 155 may be present beneath hydrocarbon layer 145. As hydrocarbons 140 are extracted from storage vessel 110, small amounts of water may also be extracted. The mixture of water 135 and hydrocarbons 140 may then be transferred to an oil/water separation unit (not shown) located outside of storage vessel 110. In other embodiments, chemicals may be introduced with gas 150 into storage vessels 110 to prevent the contamination of hydrocarbons 140 by water 135.

Figure 6:
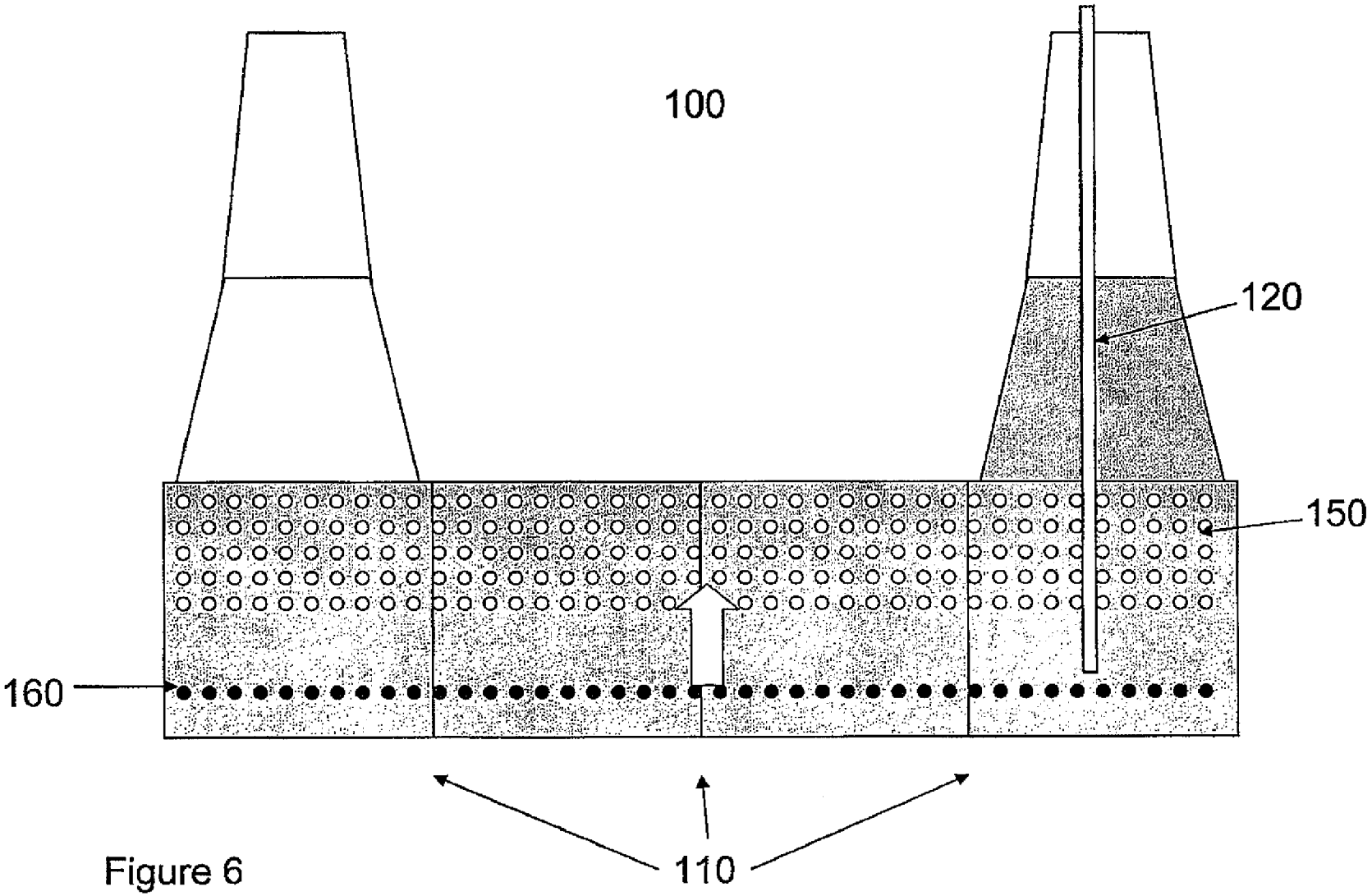
FIG. 6 is a schematic diagram of gas absorption in accordance with an embodiment of the present disclosure.

Referring now to FIG. 6, injection of a gas absorbing chemical 160, in accordance with one embodiment of the present disclosure, is shown. As hydrocarbon extraction completes, the flow direction of the external pump may be reversed, and gas absorbing chemical 160 may be introduced into storage vessel 110. Gas absorbing chemical 160 may then absorb gas 150, thereby allowing replacement water to fill open areas in storage vessel 110. While the embodiments above discuss absorption of an injected gas with a gas absorbing chemical, it should be realized that in other embodiments, the absorbing chemical may be a gas, liquid, solid, or any mixture thereof that may absorb the injected displacement material.

In certain embodiments, gas absorbing chemical 160 may include potassium hydroxide (KOH), ammonium hydroxide ($NH_4OH$), and/or ammonium chloride ($NH_4Cl$). The introduction of KOH or $NH_4OH$ removes carbon dioxide ($CO_2$) from storage vessel 110. Further, $NH_4Cl$ prevents the formation of water-insoluble mineral scales (e.g. magnesium hydroxide ($Mg(OH)_2$)), which may result from mixing seawater and KOH. Moreover, gas absorbing chemical 160 may include methanol ($CH_3OH$). The introduction of $CH_3OH$ to the KOH and $NH_4Cl$ or $NH_4OH$ solution reduces the specific gravity of the solution, thereby allowing the solution to more easily move throughout storage vessels 110. The introduction of $CH_3OH$ may also increase the rate of contact between the solution and the gas, therein speeding the absorption of the gas 150. The introduction of potassium hydroxide and ammonium chloride may be one method of removing carbon dioxide from storage vessel 110, however, embodiments employing other chemicals, or no chemicals, may be foreseen, and are within the scope of this disclosure.

While introduction of a gas absorbing chemical 160 may provide environmental or other benefits in certain applications (e.g. oil platform or storage tank decommissioning), it should be realized that embodiments that do not include use of a gas absorbing chemical 160 are within the scope of this disclosure. For example, in certain applications, it may be more economically efficient to leave the gas, whether injected or produced by chemical reaction, in the storage vessel 110. However, in embodiments that use a gas absorbing chemical, $CO_2$ may be preferable because $CO_2$ may be easily reabsorbed by aqueous solutions that may contain alkali metal hydroxide.

Figure 7:
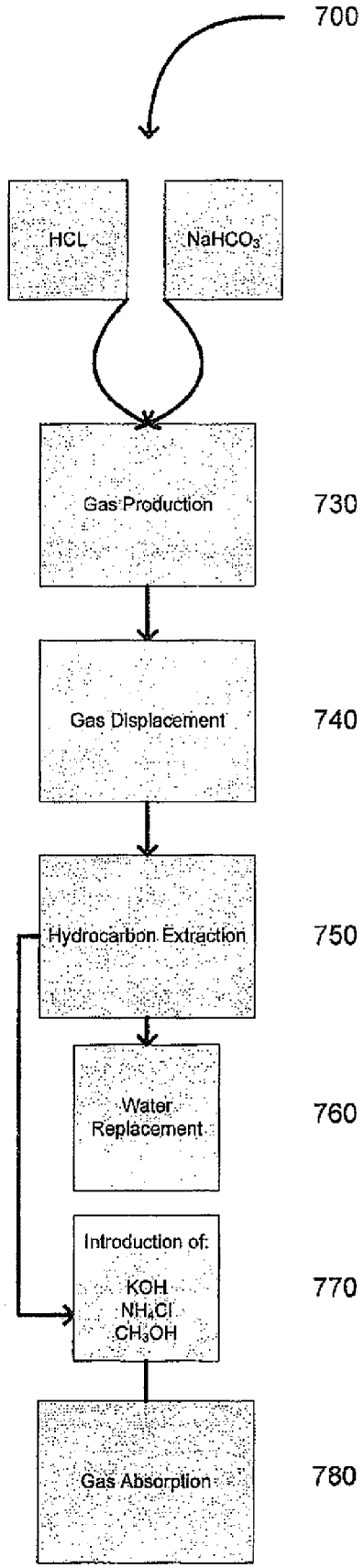
FIG. 7 is a block diagram of an alternate embodiment of a method of chemical gas production in accordance with the present disclosure.

While FIGS. 1 through 6 illustrate a method of extracting hydrocarbons using gas injection, other embodiments may be foreseen wherein at least one chemical that produces a gas is introduced to storage vessel 110. Referring now to FIG. 7, a block diagram of chemical gas production in accordance with an embodiment of the present disclosure is shown.

In one embodiment, a method of hydrocarbon recovery 700 may include a chemical solution, including hydrochloric acid (HCl) and sodium bicarbonate ($NaHCO_3$), being introduced into the storage vessel. As the chemical solution of HCl and $NaHCO_3$ react in the storage vessel, a gas ($CO_2$) may be produced 730. The gas may then rise through the storage vessel, contacting the hydrocarbons, thereby displacing 740 the hydrocarbon layer. The hydrocarbons may then be extracted 750, and water may then replace 760 the volume left by the hydrocarbons, as described above. As hydrocarbon recovery 750 completes, a gas absorption 770 chemical/solution may be introduced into the storage vessel to absorb 780 any gas that remains from gas production 730. In one embodiment, as previously described, the gas absorption chemical may include KOH, $NH_4Cl$, $NH_4OH$, and $CH_3OH$. While the described method of hydrocarbon extraction includes the production of gas by the reaction of hydrochloric acid and sodium bicarbonate, embodiments employing other chemicals that produce gases may be foreseen, and are within the scope of this disclosure. Further embodiments may include, for example, a range of metal salts of bicarbonates and carbonates, minerals and organic acids, surfactant derived foams, low dense mobile gels, gases (direct or within a deformable bladder), materials such as styrene beads, and thermally sensitive hydrocarbon particles.

While embodiments described above illustrate use of a method in the recovery of hydrocarbon sources from storage systems for oil platform storage vessels), it should be realized that methods involving the recovery of hydrocarbons from land based vessels may also fall within this scope of the present disclosure. It should be further understood that while the illustrated embodiments introduce a gas into a vessel to facilitate hydrocarbon recovery, introduction of a material of any state (e.g. a liquid, solid or gas) with a density differing from that of the material to be displaced may benefit from the present disclosure.

Advantageously, embodiments of the aforementioned methods may increase the rate of hydrocarbon extraction from vessels located on land, in the water, or connected to oil platforms. Further, because the disclosed methods may prevent the escape of hydrocarbons into the environment, certain embodiments may provide a clean process for use during the decommissioning of oil platforms and/or removal of hydrocarbons from land based vessels. Finally, because embodiments of the present disclosure may increase the yield of hydrocarbons during recovery, the operation may pay for itself, or even generate a profit.

While the present disclosure has been described with respect to a limited number of embodiments, those skilled in the art, having benefit of this disclosure, will appreciate that other embodiments can be devised which do not depart from the scope of the disclosure as described herein. Accordingly, the scope of the present disclosure should be limited only by the attached claims.

What is claimed is:

1. A method for recovering hydrocarbons from a vessel comprising:

displacing a hydrocarbon source with a material, wherein the displacing comprises:

injecting at least one chemical that reacts to form a gas into the vessel, and wherein the material has a density not equal to the hydrocarbon source; and recovering the hydrocarbon source from the vessel.

2. The method of claim 1 further comprising injecting the material into the vessel.

3. The method of claim 1 wherein the at least one chemical that reacts to form a gas comprises sodium bicarbonate and hydrochloric acid.

4. The method of claim 1 wherein the at least one chemical that reacts to form the gas comprises salts and acids that react to generate gas.

5. The method of claim 1 wherein the material is a liquid.

6. The method of claim 1 wherein the material is a solid.

7. The method of claim 1 further comprising transferring the hydrocarbon source from the vessel to an oil platform.

8. The method of claim 1 wherein the hydrocarbon source is oil.

9. The method of claim 1 wherein the material is a gas.

10. The method of claim 1 further comprising:

injecting a material absorbing chemical into the vessel; and removing the material with the material absorbing chemical.

11. The method of claim 10 wherein the material absorbing chemical comprises at least one of potassium hydroxide, ammonium chloride, ammonium hydroxide, methanol, and combinations thereof.

12. The method of claim 1 further comprising separating the hydrocarbons from water in a separator system.

13. A method of recovering hydrocarbons from a vessel comprising:

introducing hydrochloric acid and sodium bicarbonate into a vessel;

producing carbon dioxide from the reaction of the hydrochloric acid and the sodium bicarbonate;

displacing a hydrocarbon source inside the vessel; and recovering the hydrocarbon source from the vessel.

14. The method of claims 13 further comprising injecting potassium hydroxide into the vessel.

15. The method of claim 13 further comprising injecting ammonium hydroxide into the vessel.

16. The method of claim 13 further comprising injecting methanol into the vessel.

* * * * *